US009254031B1

(12) United States Patent
Zenoff

(10) Patent No.: US 9,254,031 B1
(45) Date of Patent: Feb. 9, 2016

(54) WEARABLE SUPPORT BELT

(71) Applicant: ZENOFF PRODUCTS, INC., San Anselmo, CA (US)

(72) Inventor: Andrew R. Zenoff, San Francisco, CA (US)

(73) Assignee: ZENOFF PRODUCTS, INC., San Anselmo, CA (US)

( * ) Notice: Subject to any disclaimer, the term of this patent is extended or adjusted under 35 U.S.C. 154(b) by 74 days.

(21) Appl. No.: 14/174,664

(22) Filed: Feb. 6, 2014

(51) Int. Cl.

| | |
|---|---|
| ***A47B 23/00*** | (2006.01) |
| ***A47C 16/00*** | (2006.01) |
| ***A45F 5/00*** | (2006.01) |
| *A47G 23/06* | (2006.01) |

(52) U.S. Cl.
CPC ..... *A45F 5/00* (2013.01); *A47B 23/002* (2013.01); *A47C 16/00* (2013.01); *A47G 23/0608* (2013.01)

(58) Field of Classification Search
CPC . A47D 13/083; A47C 16/00; A47G 23/0608; A47B 23/002
USPC ..... 224/158, 159, 270; 5/655; 108/43
See application file for complete search history.

(56) References Cited

U.S. PATENT DOCUMENTS

| | | | | | |
|---|---|---|---|---|---|
| 2,806,609 | A | * | 9/1957 | Grobizna | 211/90.01 |
| 3,125,825 | A | * | 3/1964 | Gaudette | 248/444 |
| 4,676,419 | A | * | 6/1987 | Victor | 224/649 |
| 4,788,916 | A | * | 12/1988 | Saxton | 108/43 |
| 4,901,898 | A | * | 2/1990 | Colombo et al. | 224/159 |
| 5,069,375 | A | * | 12/1991 | Flick | 224/564 |
| 5,221,032 | A | * | 6/1993 | Bott et al. | 224/270 |
| 5,224,637 | A | * | 7/1993 | Colombo | 224/159 |
| 5,240,156 | A | * | 8/1993 | Sicotte et al. | 224/583 |
| 5,355,811 | A | * | 10/1994 | Brewer | 108/43 |
| 5,421,809 | A | * | 6/1995 | Rise | 602/19 |
| 5,429,057 | A | * | 7/1995 | Buescher | 108/43 |
| 5,456,394 | A | * | 10/1995 | Israel | 224/270 |
| 5,464,136 | A | * | 11/1995 | Eddy | 224/666 |
| 5,492,256 | A | * | 2/1996 | Ive | 224/159 |
| 5,581,833 | A | * | 12/1996 | Zenoff | 5/655 |
| 5,628,141 | A | * | 5/1997 | Crawford | 43/54.1 |
| 5,790,999 | A | * | 8/1998 | Clark | 5/655 |
| 5,871,132 | A | * | 2/1999 | Hargreaves | 224/576 |
| 6,041,715 | A | * | 3/2000 | Jarke et al. | 108/43 |
| 6,053,383 | A | * | 4/2000 | Gunderson | 224/270 |
| 6,061,854 | A | * | 5/2000 | Crowley | 5/655 |
| 6,116,166 | A | * | 9/2000 | Rotstein | 108/43 |
| 6,119,390 | A | * | 9/2000 | Dickie | 43/54.1 |
| D433,580 | S | * | 11/2000 | Jarke et al. | D6/406.5 |
| 6,685,024 | B1 | * | 2/2004 | Matthews | 206/521 |
| 6,851,143 | B2 | * | 2/2005 | Matthews Brown | 5/490 |
| D550,477 | S | * | 9/2007 | Probst | D6/406.5 |
| 7,290,303 | B2 | * | 11/2007 | Mead et al. | 5/655 |

(Continued)

*Primary Examiner* — Justin Larson
(74) *Attorney, Agent, or Firm* — Siritzky Law, PLLC

(57) ABSTRACT

A wearable support belt is provided. The wearable support belt includes a support surface having a first end and a second end, the first end and the second end configured to fasten to each other, the support surface composed of a first material disposed over a second material. The wearable support belt includes a section coupling the first end and the second end, the section coupling the first end and the second end having a thickness and a height that is different than a thickness and a height of a front section of the structure. The wearable support belt includes a removable cover disposed around the support belt, the removable cover having an outer surface, the outer surface having a fastening mechanism affixed thereto, the fastening mechanism proximate to the first end and the second end.

13 Claims, 9 Drawing Sheets

(56) References Cited

U.S. PATENT DOCUMENTS

| | | | | |
|---|---|---|---|---|
| 7,464,423 | B2 * | 12/2008 | Goodwin et al. | 5/655 |
| 7,575,136 | B2 * | 8/2009 | Kernkamp | 224/159 |
| 7,587,773 | B2 * | 9/2009 | Littlehorn et al. | 5/655 |
| 7,703,159 | B2 * | 4/2010 | Parrilla | 5/655 |
| 7,992,502 | B1 * | 8/2011 | Davis | 108/43 |
| 8,091,486 | B1 * | 1/2012 | Broaddrick | 108/43 |
| 8,464,919 | B1 * | 6/2013 | Goozdich | 224/159 |
| 8,590,078 | B1 * | 11/2013 | Zenoff | 5/655 |
| D699,981 | S * | 2/2014 | Kummerfeld et al. | D6/601 |
| D699,982 | S * | 2/2014 | Fair et al. | D6/601 |
| 2002/0023301 | A1 * | 2/2002 | Vuuren | 5/655 |
| 2004/0118883 | A1 * | 6/2004 | Fife et al. | 224/159 |
| 2005/0278853 | A1 * | 12/2005 | Littlehorn et al. | 5/636 |
| 2006/0097019 | A1 * | 5/2006 | Just-Buddy | 224/148.7 |
| 2007/0056110 | A1 * | 3/2007 | Tuoriniemi et al. | 5/655 |
| 2007/0246493 | A1 * | 10/2007 | Kernkamp | 224/159 |
| 2007/0277711 | A1 * | 12/2007 | Grant | 108/160 |
| 2008/0047987 | A1 * | 2/2008 | Price | 224/159 |
| 2009/0179055 | A1 * | 7/2009 | Estrellado | 224/269 |
| 2009/0308900 | A1 * | 12/2009 | Kernkamp | 224/158 |
| 2010/0043623 | A1 * | 2/2010 | Goodrich | 84/423 R |
| 2010/0236452 | A1 * | 9/2010 | Ruddy | 108/6 |
| 2011/0139039 | A1 * | 6/2011 | Peters | 108/42 |
| 2013/0145556 | A1 * | 6/2013 | Kummerfeld et al. | 5/655 |
| 2015/0157139 | A1 * | 6/2015 | Gillam | 224/158 |

* cited by examiner

WEARABLE SUPPORT BELT

BACKGROUND

A number of support structures are known. Reference may be made, for example, to U.S. Pat. No. 5,591,122 (Yewer), U.S. Pat. No. 6,068,606 (Castel), U.S. Pat. No. 6,575,876 (Phelps-McMillon), U.S. Pat. No. 8,272,546 (Leistensnider), U.S. Pat. No. 6,058,513 (Simmons), U.S. Pat. No. 6,513,523 (Izuchukwu), U.S. Pat. No. 6,434,770 (Matthews), U.S. Pat. No. 6,685,024 (Matthews), U.S. Pat. No. 7,055,196 (Littlehorn), U.S. Pat. No. 7,127,760 (Bartley), U.S. Pat. No. 7,290,303 (Mead), U.S. Pat. No. 7,587,773 (Littlehorn), U.S. Pat. No. 5,664,828 (Simon), U.S. Pat. No. 5,790,999 (Clark), U.S. Pat. No. 7,010,821 (Leach), U.S. Pat. No. 5,581,833 (Zenoff), and US 2007/0056110 (Tuoriniemi). The entire disclosure of each of those US patents and patent publication is incorporated herein by reference for all purposes. Yet, there are further uses and needs not addressed by these and other support belts. Therefore, there is a need in the art for further improvements in support belts that can be worn by a user.

SUMMARY

A wearable support belt is provided. The wearable support belt includes a support surface having a first end and a second end, the first end and the second end configured to fasten to each other to define an opening adapted to fit around a user's waist, the support surface composed of a compressible material, the support surface having a ramp configuration causing an object resting on the support surface to be coerced toward the opening. In some embodiments the support belt includes a support surface having a first end and a second end, the first end and the second end configured to fasten to each other to define an opening adapted to fit around a user's waist, the support surface composed of a first material and a second material, the first material disposed over the second material, the first material being softer than the second material, the support surface configured to support an object resting on the support surface. The wearable support belt includes a section coupling the first end and the second end, the section coupling the first end and the second end having a thickness and a height that is different than a thickness and a height of a front section of the structure, the section coupling the first end and the second end having the first material and the second material. The wearable support belt includes a removable cover disposed around the support belt, the removable cover having an outer surface, the outer surface having a fastening mechanism affixed thereto, the fastening mechanism proximate to the first end and the second end. In some embodiments the support surface is inclined or contoured. In some embodiments a detachable tray is included.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

A wearable support belt described herein can fasten around the waist of a user, and has many features, variations and embodiments. Some embodiments are unitary bodies, others have two or more pieces that can be separated or attached to each other. A pocket or pouch, various attachable or detachable trays, adjustments and/or swappable inserts are present in various combinations in embodiments, giving the wearable support belt versatility and adaptability, and customizing the wearable support belt for individual preferences and needs.

Figure 1:
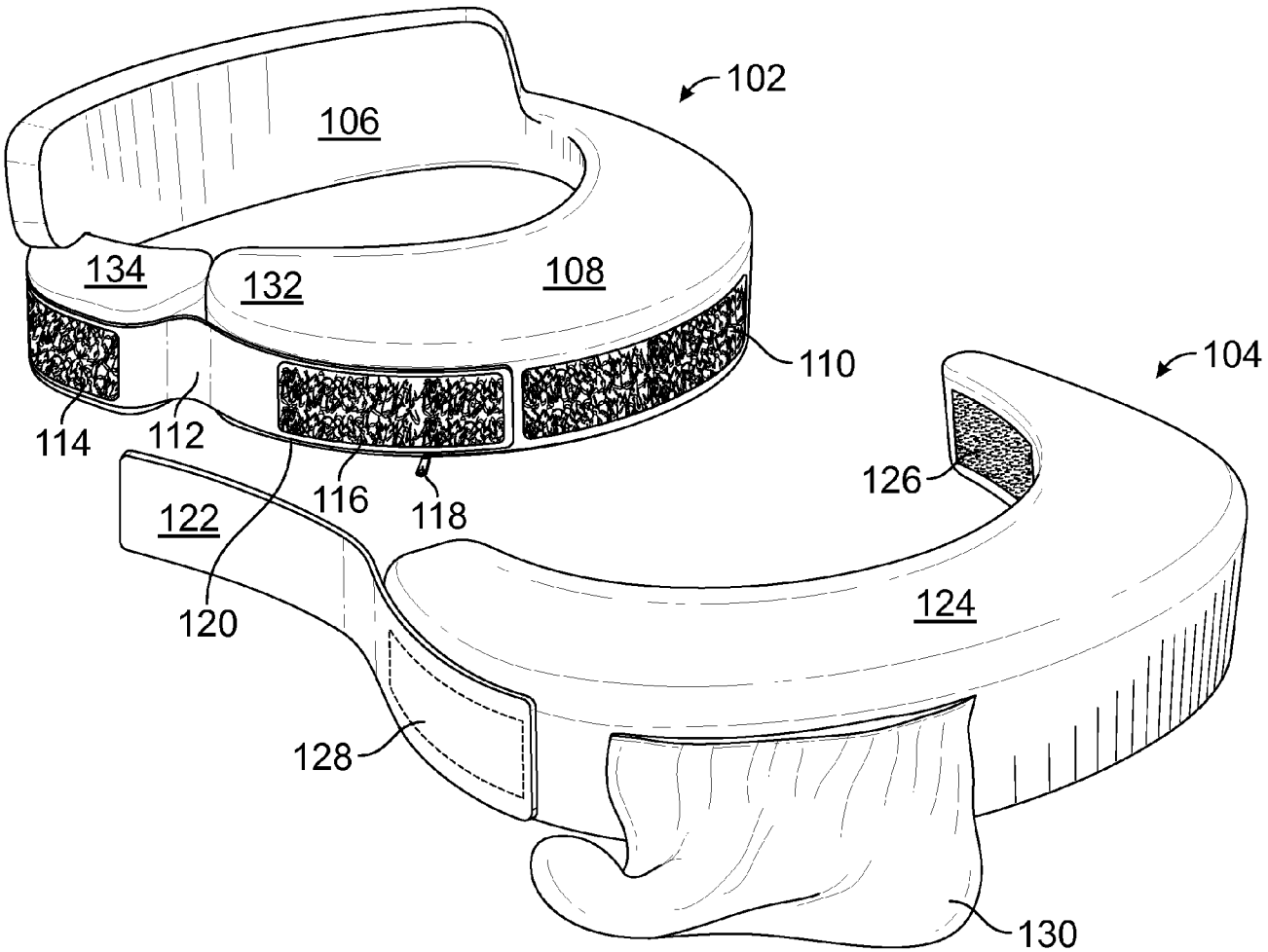
FIG. 1 is a perspective view of a wearable support belt with various features.

FIG. 1 is a perspective view of a wearable support belt with various features. Orientations of the various portions and features of the wearable support belt are given relative to a user wearing the structure, e.g., a front portion of the support belt is relative to a front of the user. A main body member 102 of the wearable support belt can be worn all by itself, or can be worn with a front member 104 of the wearable support belt. The main body member 102 fastens around the waist of a user, with a back section 106 on a backside of the user and a front section 108 on the front side of the user. A short arm 134 extends from one side of the back section 106, and a long arm 132 extends from an opposing side of the back section 106. Here, the short arm 134 is on the right side of the main body member 102, and the long arm 132 is on the left side of the main body member, as viewed when wearing the wearable support belt. However, the short arm 134 is readily relocated to the left side, and the long arm 132 to the right side, in further embodiments. A belt strap 112 extends from the short arm 134 and fastens to an outer surface 110 of the long arm 132. For example, hook and loop fasteners could be used, or snaps, or catches, or other known fasteners. In this example, the outer surface 110 of the long arm 132 includes a fastening surface, which could be of a similar material to further fastening surfaces 114, 116. The fastening surface 114 is on an outer surface of the short arm 134, and a further fastening surface 116 is on an outer surface at an end of the belt strap 112. These fastening surfaces 114, 116, including the outer surface 110, are available for mating to respective fastening surfaces 126 along an inner surface of the front member 104.

The front member 104 fastens to the front surface of the main body member 102. In this example, the front surface of the main body member 102 includes the outer surface 110 of the long arm 132, and a fastening surface 114 on an outer surface of the short arm 134. Side surfaces of the short arm 134 and the long arm 132 could also be used for fastening, using a side fastening tab 122 of the front member 104. A portion or the entirety of a back surface of the back section 106 could also be used for fastening. An inner surface 126 of the front member 104 is contoured as a convex curve, for close fitment and includes a suitable fastening material, such as discussed above, for mating to the fastening surfaces 114, 116, including the outer surface 110, of the main body member 102. One or more fastening surfaces 128 are provided, on sides and/or the front of the front member 104.

Various shapes and construction materials and techniques can be employed in embodiments of the support belt. The main body member 102 and the front member 104 can each be unitary bodies, or one or both can be built up from two or more layers. For example, a firm layer of open cell or a closed cell foam rubber could be used as a lower layer, and a softer, less firm layer of open cell or closed cell foam rubber could be used as a middle or an upper layer. A front wall of either the main body member 102 or the front member 104 can be vertical, or sloped towards the user or sloped away from the user, and can be flat, or curved in a convex or a concave shape. An upper surface 108 of the long arm 132 of the main body member 102 can be essentially level, or can be tilted or sloped downward toward the user from an outer edge of the support belt in order to encourage objects not to roll off the upper surface 108. Similarly, an upper surface 124 of the front member 104 can be essentially level, or can be tilted downward toward the user. The upper surface 108 of the long arm 132 of the main body member 102, and/or the upper surface 124 of the front member 104 could have one or more bumps or hills, and these bumps or hills could be positioned towards the front, to the sides, or elsewhere. Back support can be provided by the back section 106 of the main body member 102, for example by having the back section 106 taller than the upper surface 108 of the long arm 132. The back section 106 could employ stiffeners inside, or be built up of multiple layers or materials in some embodiments.

A zipper 118 can be included in order to open a removable cover 120, so that the cover 120 can be removed from the main body member 102, e.g., for washing. The front member 104 could have a similar removable cover and zipper. Other fastening means, for example hook and loop fasteners, buttons or clasps etc., could be used to open and close a removable cover. In the embodiment shown, the front member 104 has an optional pocket or pouch 130, which could be sewn onto or otherwise attached to a removable cover, or fastened directly to a body of the front member 104.

Figure 2:
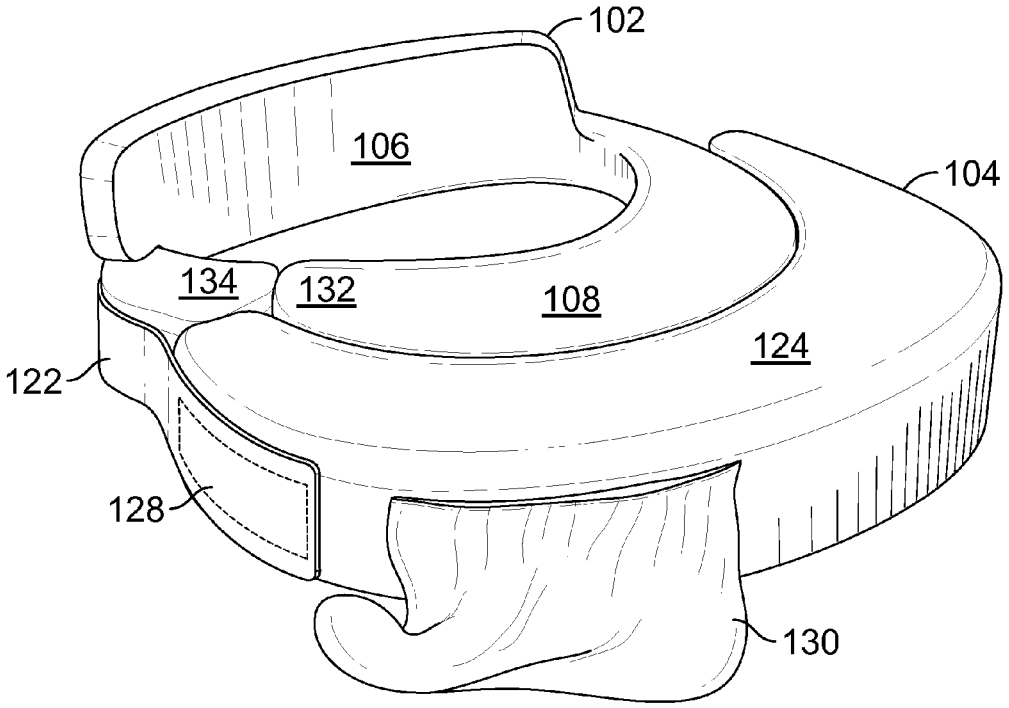
FIG. 2 is a perspective view of the main body member of the wearable support belt of FIG. 1, closed as if around the waist of a user, with the detachable front member attached to the main body member.

FIG. 2 is a perspective view of the main body member 102 of the wearable support belt of FIG. 1, closed as if around the waist of a user, with the detachable front member 104 attached to the main body member 102. Depending upon the girth of the waist of the user, ends of the short arm 134 and the long arm 132 may but up against one another, as shown in FIG. 2, or may have a gap between the two, or may overlap (see FIG. 5A), thus accommodating different sizes of waistlines. Some embodiments may be sold in a variety of sizes, while nonetheless having adjustability. An opening defined between the back section 106 and arms 132 and 134 is adjustable to fit varying waist sizes.

Figure 3:
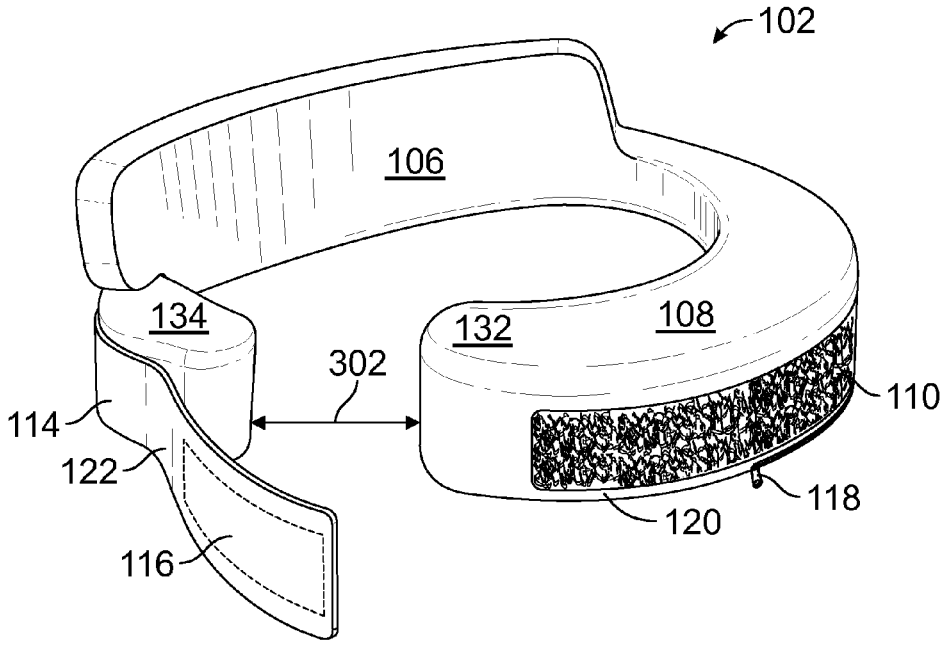
FIG. 3 is a perspective view of the main body member of FIG. 1, opened.

FIG. 3 is a perspective view of the main body member 102 of FIG. 1, opened. The belt strap 112 unfastens from the outer surface 110 of the long arm 132, and a gap 302 can be opened up between the long arm 132 and the short arm 134. A user then maneuvers the long arm 132 around the waist, with the back section 106 to the backside of the user, and maneuvers the short arm 134 to the side of the user, fastening the belt strap 112 to the outer surface 110 of the long arm 132 as the gap 302 closes.

Figure 4:
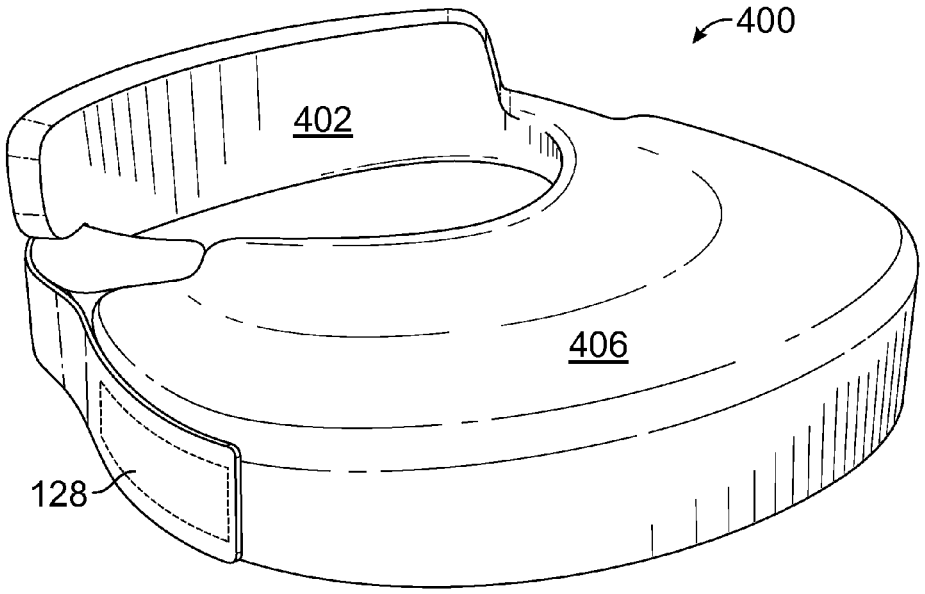
FIG. 4 is a perspective view of a main body member, closed, with an integral front member.

FIG. 4 is a perspective view of a support belt 400, closed, with an integral front member 406. That is, a back section 402 and a front member 406 are integral with one another, forming a unitary body. Conceptually, this can be viewed as an embodiment of the main body member 102, with an extended long arm 132, such that the long arm 132 is filled out to become the integral front member 406. Alternatively, this can be viewed as an embodiment of the main body member 102, with the front member 104 joined integrally with the long arm 132, as the integral front member 406. Variations of this embodiment could include a removable cover, single or multiple layers of similar or differing densities of resilient material, pockets, hills, inclined surfaces and other features similar to those previously discussed.

Figure 5A:
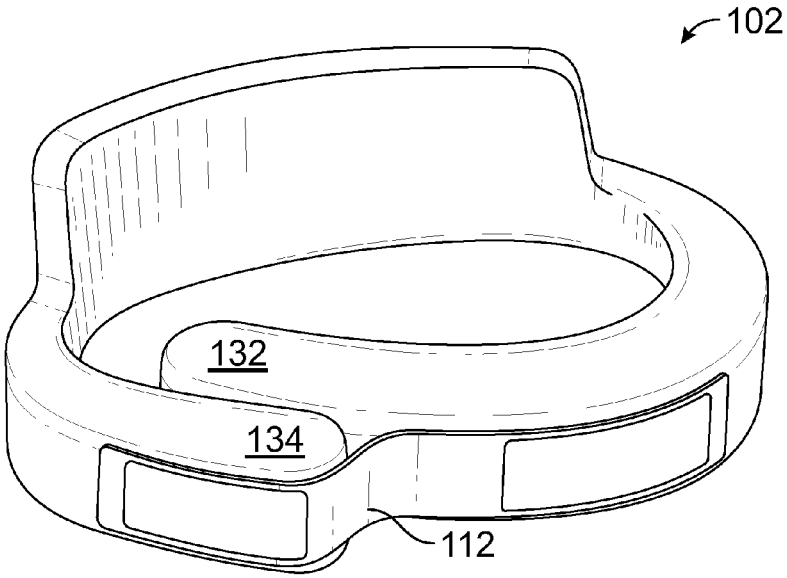
FIG. 5A is a perspective view of the main body member, closed more tightly than shown in FIG. 1, demonstrating adjustability.
Figure 5B:
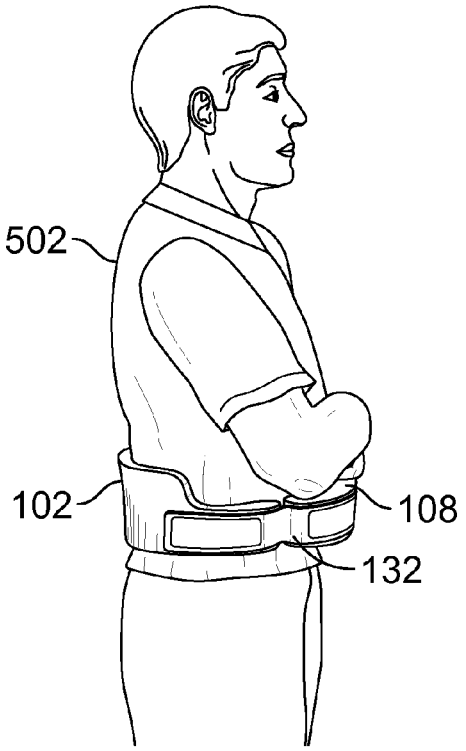
FIG. 5B is a perspective view of the main body member fastened around the waist of a user.

FIG. 5A is a perspective view of the main body member 102 in a closed position. As mentioned previously, the short arm 134 and the long arm 132 can overlap to accommodate a narrower waistline of the user. FIG. 5B is a perspective view of the main body member 102 fastened around the waist of a user 502. Here, the user 502 is shown resting arms (elbows and forearms on top of the main body member, specifically on the upper surface 108 of the long arm 132 of the main body member 102. This could be useful for comfort, easing strain of an injury, or assistance in carrying articles such as a bag of groceries. Additional straps could be added to employ the main body member 102 as an immobilizer for healing a broken arm or damaged soft tissues. Employed thusly, an embodiment of the main body member 102 could be useful in physical therapy and in recovery from injuries.

Figure 5C:
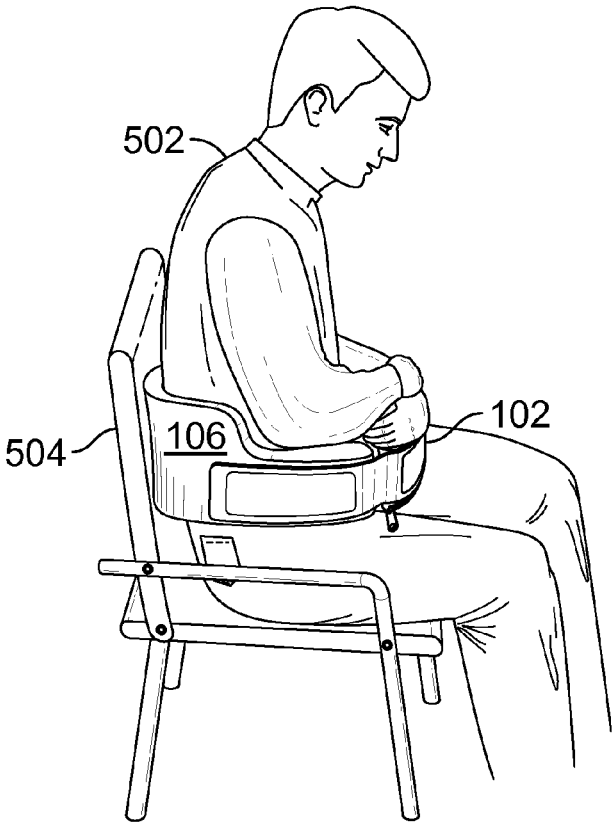
FIG. 5C is a perspective view of the user, wearing the main body member, seated.

FIG. 5C is a perspective view of the user 502, wearing the main body member 102, seated. The back section 106 of the main body member 102 provides further back support to the user 502 in combination with the back of the chair 504. A lower portion of the long arm 132 wrists on the lap of the user 502, while the upper portion of the long arm 130 to provide support for the hands and arms of the user 502.

Figure 6A:
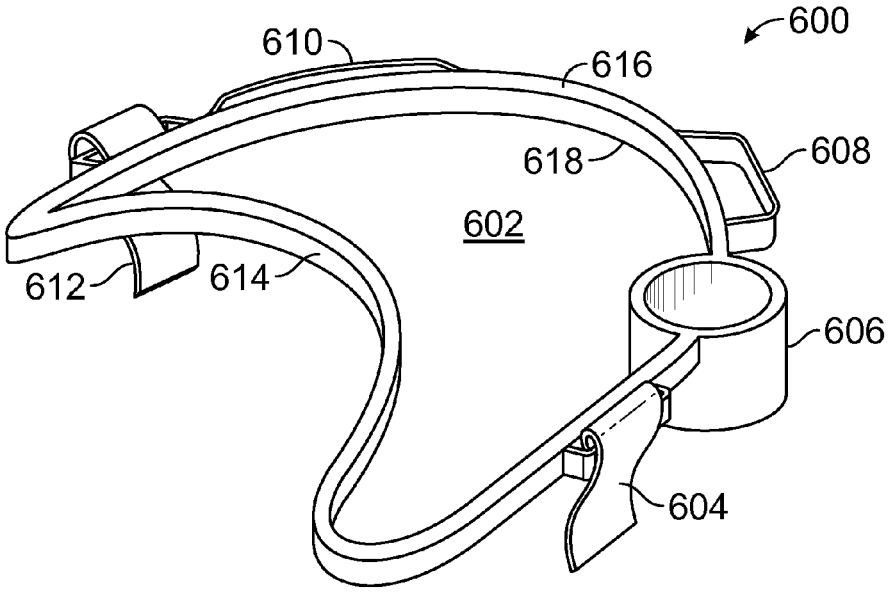
FIG. 6A is a perspective view of an attachable tray, which can be affixed to the wearable support belt.

FIG. 6A is a perspective view of an attachable tray 600, which can be affixed to the wearable support belt. Many types and configurations of trays are possible. This embodiment of an attachable tray 600 features a flat surface 602, side attachment tabs 604, 612, a cup holder 606, and further object holders 608, 610. Some embodiments have a raised ridge 616 around an outer perimeter or periphery of the tray 600, which can prevent objects from rolling off of the flat surface 602.

Figure 6B:
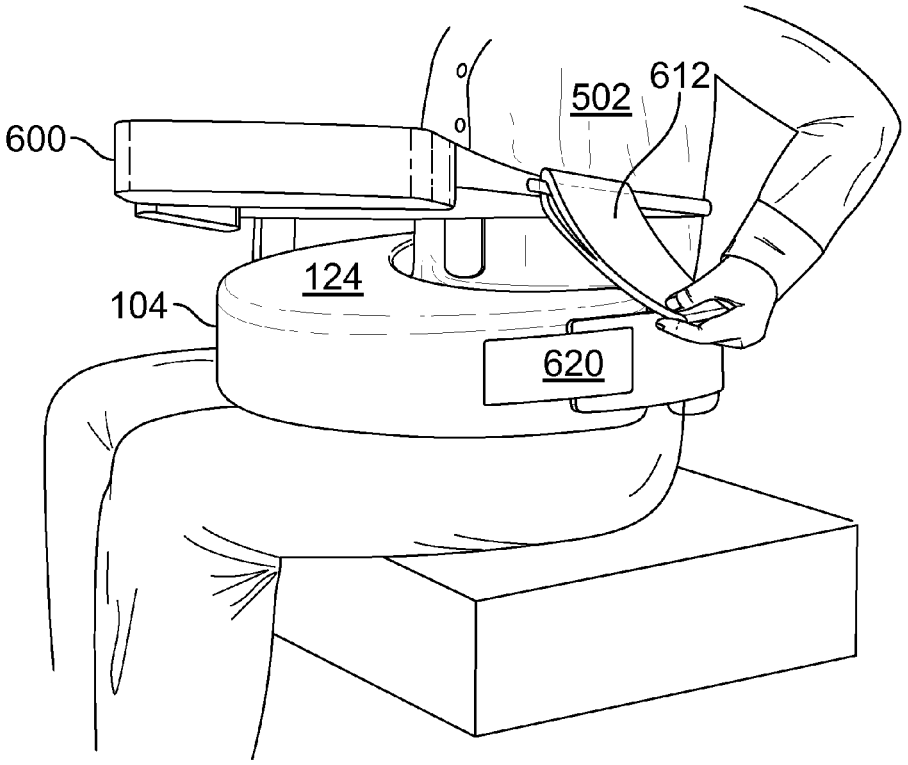
FIG. 6B is a perspective view showing the attachable tray of FIG. 6A in the process of being secured to the wearable support belt, which is fastened around the waist of a user.

FIG. 6B is a perspective view showing the attachable tray 600 of FIG. 6A in the process of being secured to the wearable support belt 104, which is fastened around the waist of a user 502. As the tray 600 is lowered, the side attachment tab 612 is attached to an attachment surface 620 of the wearable support belt 104. For example, the attachment surface 620 could be similar to the fastening surface 114 on the outer surface of the short arm 134 in some embodiments.

Figure 6C:
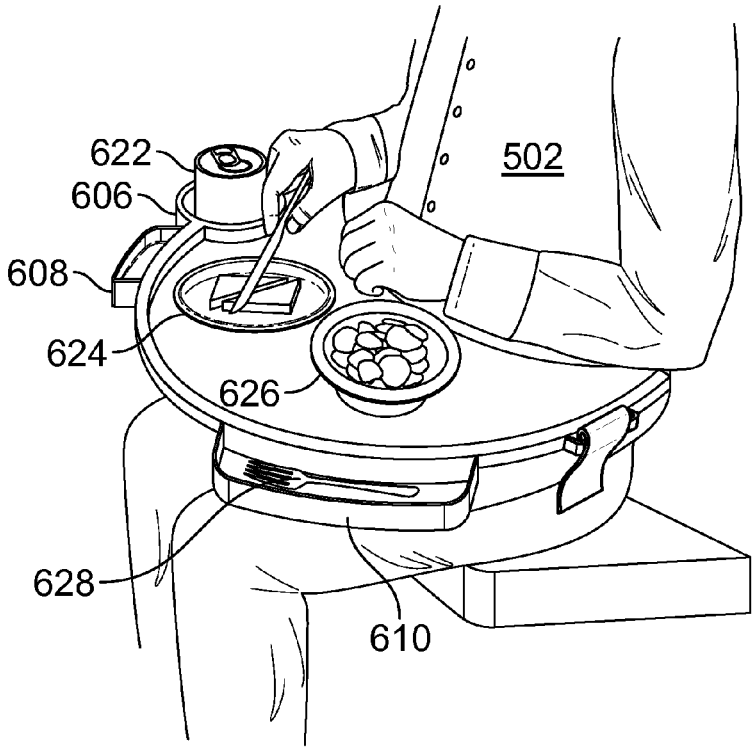
FIG. 6C is a perspective view of the user, seated, wearing the wearable support belt with the attachable tray of FIG. 6A attached to the wearable support belt.

FIG. 6C is a perspective view of the user, seated, wearing the wearable support belt with the attachable tray of FIG. 6A attached to the wearable support belt. User 502 is utilizing the wearable support belt to hold food items for eating. Plates 624 and 626 are supported on the top surface of the wearable support belt. Compartment 606 is holding a beverage 622, while trays 608 and 610 are configured to hold utensil 628 or other items.

Figure 7A:
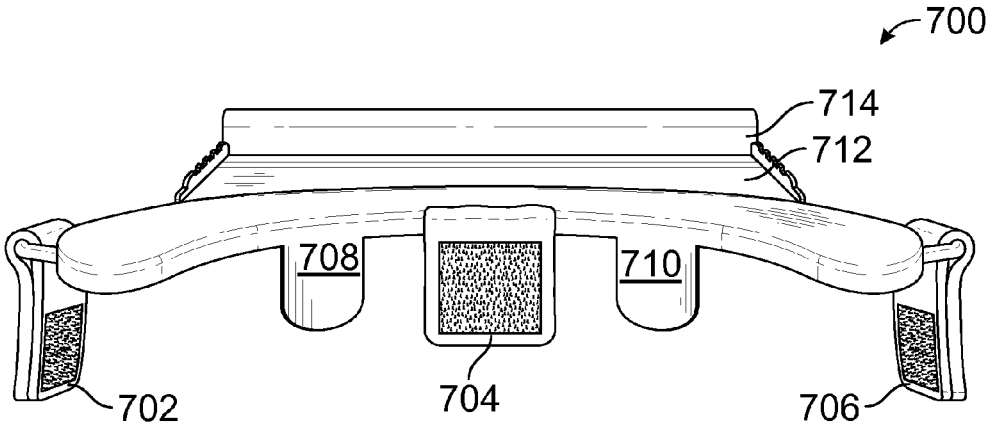
FIG. 7A is a perspective view of another attachable tray, which can be affixed to the wearable support belt.

FIG. 7A is a perspective view of a detachable tray, which can be affixed to the wearable support belt. Tray 700 includes stop 714 extending from the base of the tray also referred to as surface 712. Tray 700 includes fastening mechanisms 702 and 706 that in some embodiments wrap around opposing side sections of the wearable support belt. Fastening mechanism 704 may also be included as a further anchor point for the detachable tray 700 along the inner side surface of the wearable belt proximate to the user's waist. In addition, tabs 708 and 710 may be used to anchor tray 700 on the surface of the front section of the wearable belt. In some embodiments tabs 708 and 710 are composed of a rigid material and extend between the surfaces of the wearable belt and front section 104 of FIG. 1 or on the inner side surface of the embodiment of FIG. 4.

Figure 7B:
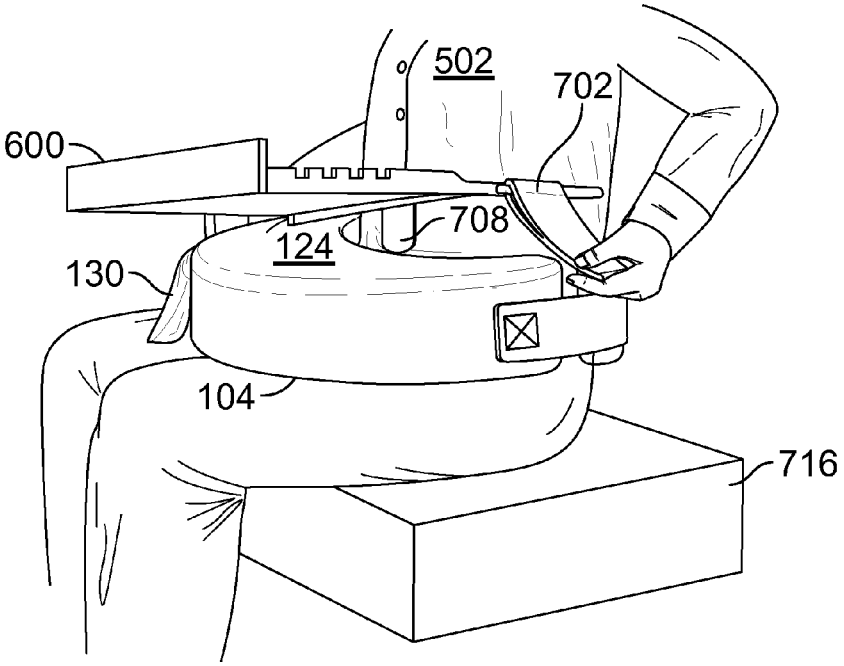
FIG. 7B is a perspective view showing the attachable tray of FIG. 7A in the process of being secured to the wearable support belt, which is fastened around the waist of a user.
Figure 7C:
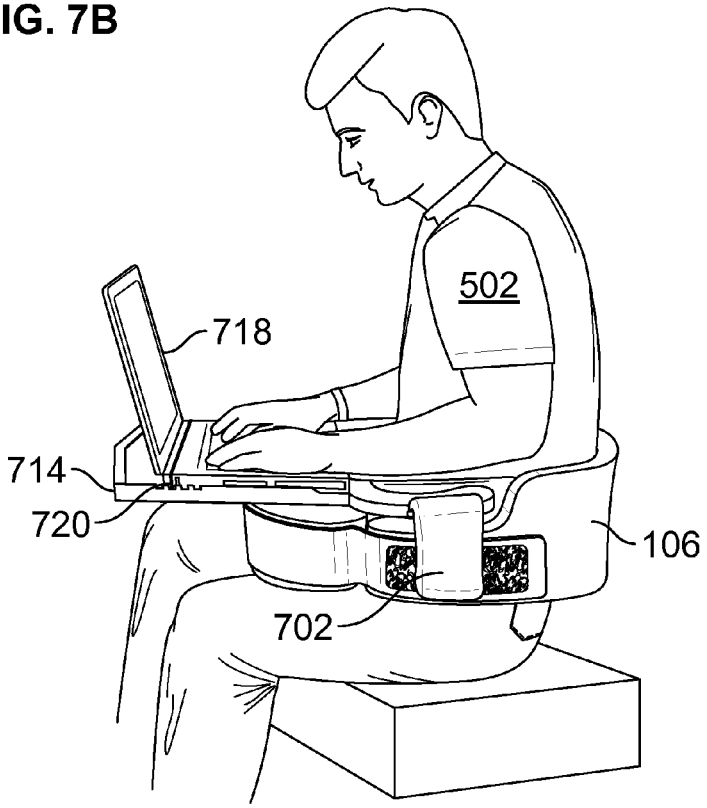
FIG. 7C is a perspective view of the user, seated, wearing the wearable support belt with the attachable tray of FIG. 7A attached to the wearable support belt.

FIG. 7B is a perspective view showing the attachable tray of FIG. 7A in the process of being secured to the wearable support belt, which is fastened around the waist of a user. Tray 600 rests on upper surface 124 of the front section 104 of the wearable belt. Tab 708 and fastening mechanism 702 are utilized to anchor tray 600 to the wearable belt as user 502 sits in chair 716. Pocket 130 is optional and extends from the outer surface of front section 104. In some embodiments, tray 600 may support a computing device 718 as illustrated in FIG. 7C. The detachable tray is anchored to the wearable belt as illustrated by fastening mechanism 702 looped around a side section of the wearable belt. Section 106 of the wearable belt is between the first and second ends of the wearable belt against the back of user 502. It should be appreciated that section 106 is illustrated as having a different height and thickness than the front section of the wearable belt in this embodiment. Backstop 714 extends from the base of the detachable tray. Side extensions extend orthogonally from backstop 714 along the sides of the detachable tray. Strap 720 is utilized to secure device 718 and in some embodiments, strap 720 is an elastic material help in opposing notches defined along the upper surface of the side extensions. It should be appreciated that the wearable belt disclosed herein is a modular unit in some embodiments. As illustrated herein, the wearable belt can include a detachable front section (see FIG. 1) and various add-ons, such as a tray, pockets, cup holders, etc.

Figure 8A:
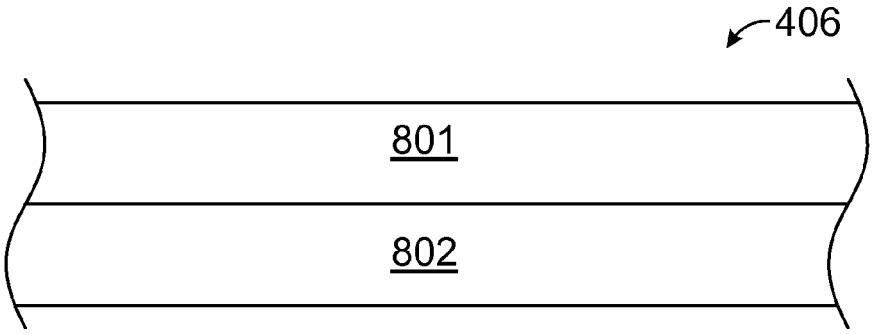
FIGS. 8A and 8B are cross sectional views of the support belt in accordance with some embodiments.
Figure 8B:
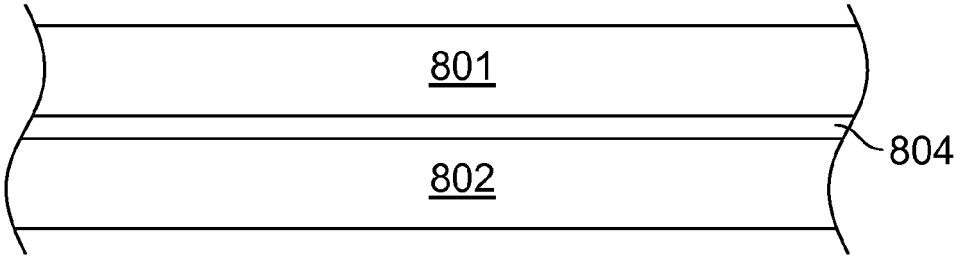

FIGS. 8A and 8B are cross sectional views of the support belt in accordance with some embodiments. Front member 406 is composed of a first material 801 and a second material 802. In some embodiments, the first material 801 is softer than the second material 802. In some embodiments, the thicknesses of material 801 is different than the thickness of material 802. Material 801 and material 802 may be foam materials and the rigidity or hardness of the bottom material of the front member 406 can be greater than the rigidity or hardness of the top material of the front member. It should be appreciate that while the properties of the core material for the front member 406 is being discussed here, this is not meant to be limiting as the back and side sections of the support belt may include the same types of material in the same configuration as the front member. FIG. 8B illustrates a cross sectional view of the support belt having a third material 804 disposed between the first material 801 and the second material 802. In some embodiments, the third material is a non-foam material, such as a thin plate of a lightweight metal, plastic or other solid material that further adds support or rigidity without adding excessive weight. It should be appreciate that some sections of the wearable belt may have different numbers of the layers illustrate herein. For example, section 106 may include a softer or less rigid material may be sandwiched between a harder more rigid material. In some embodiments, material 804 may be disposed in the front section 104 but not section 106.

Figure 9A:
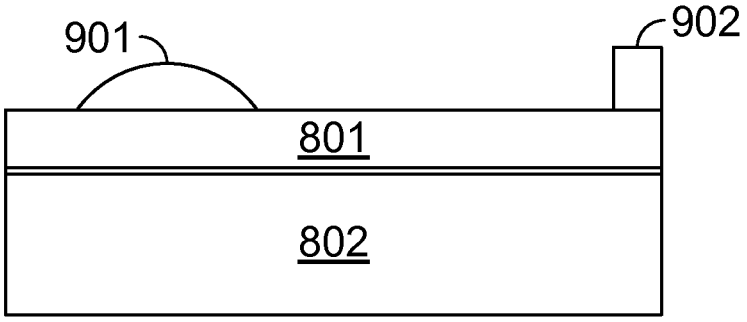
FIGS. 9A-9C are cross sectional illustrations of the front portion of the wearable belt in accordance with some embodiments.
Figure 9B:
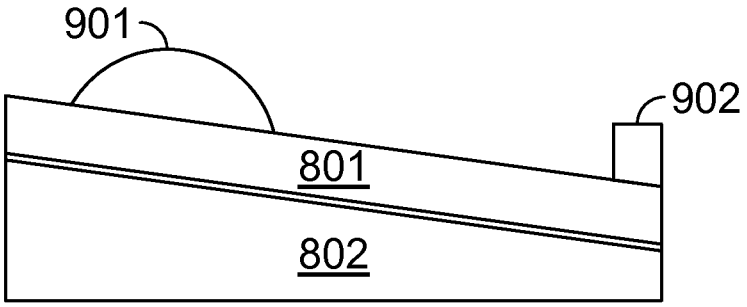
Figure 9C:
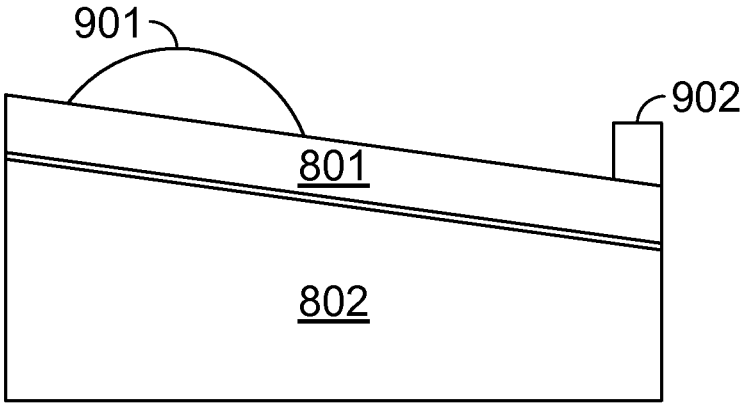

FIGS. 9A-9C are cross sectional illustrations of the front portion of the wearable belt in accordance with some embodiments. FIG. 9A illustrates the front portion of the wearable belt having a relatively flat surface for a user when wearing the belt. Material 801 is disposed over material 802 and both material 801 and 802 have constant thicknesses. Protrusion 901 and inner extension or end stop 902 extend from a top surface of material 801. It should be appreciated that protrusion 901 and stop 902 may be formed from the same material or different material relative to each other. In addition, protrusion 901 and stop 902 may be formed from the same material or different material used for material 801 and material 802. FIGS. 9B and 9C are illustrations depicting a slanted or inclined surface for the front portion of the wearable belt. That is, the surface of the front portion is slanted or inclined downwards from the outer edge toward the inner edge proximate to stop 902. The incline may be referred to as a ramp in some embodiments. The ramp configuration may range from a slight ramp that may not be visibly noticeable to a significant ramp that is visibly noticeable in some embodiments. In other embodiments the ramp may be made up of multiple incline segments having different slopes. The inner edge is also proximate to the user's waist when the user wears the belt. While material 802 is illustrated as defining the slope of the top surface this is not meant to be limiting as material 801 can also define the slope or the slope can be defined by a combination of material 801 and 802. In addition, the angle of the slope can vary between no angle and a 90 degree angle. It should be appreciated that a cover may be utilized to cover protrusion 901, stop 902, and the front surface as a unitary piece or as individual pieces.

Detailed illustrative embodiments are disclosed herein. However, specific functional details disclosed herein are merely representative for purposes of describing embodiments. Embodiments may, however, be embodied in many alternate forms and should not be construed as limited to only the embodiments set forth herein.

It should be understood that although the terms first, second, etc. may be used herein to describe various steps or calculations, these steps or calculations should not be limited by these terms. These terms are only used to distinguish one step or calculation from another. For example, a first calculation could be termed a second calculation, and, similarly, a second step could be termed a first step, without departing from the scope of this disclosure. As used herein, the term "and/or" and the "I" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A wearable support belt comprising:

a support surface having a first end and a second end, the first end and the second end configured to fasten to each other to define an opening adapted to fit around a user's waist, the support surface composed of a compressible material, the support surface having a ramp configuration from an outer area toward an inner area where a front of the user's waist is located; and a detachable tray disposed over a portion of the support surface, the detachable tray anchored to opposing side sections of the support belt and an inner side surface of the support surface, the inner side surface defining the opening, the inner side surface located between the opposing side section.

2. The wearable support belt of claim 1, further comprising:

a section coupling the first end and the second end, the section coupling the first end and the second end composed of one of a single material or multiple layers of the compressible material; and a removable cover disposed around the support belt, the removable cover having an outer surface, the outer surface having a fastening mechanism affixed thereto, the fastening mechanism proximate to the first end and the second end, wherein the compressible material of the support surface includes a first material and a second material, the first material disposed over the second material, the first material being softer than the second material.

3. The wearable support belt of claim 1 wherein the detachable tray includes an extension extending from a base of the detachable tray, the detachable tray including opposing side extensions extending from the base, the opposing side extensions orthogonal to a plane of the extension.

4. A wearable support belt comprising:

a support surface having a first end and a second end, the first end and the second end configured to fasten to each other to define an opening adapted to fit around a user's waist, the support surface composed of a first material and a second material, the first material disposed over the second material, the first material being softer than the second material, the support surface configured to support an object resting on the support surface;

a section coupling the first end and the second end, the section coupling the first end and the second end having a thickness and a height that is one of different or equivalent to a thickness and a height of a front section of the structure, the section coupling the first end and the second end having the first material and the second material;

a removable cover disposed around the support belt, the removable cover having an outer surface, the outer surface having a fastening mechanism affixed thereto, the fastening mechanism proximate to the first end and the second end; and a detachable tray disposed over a portion of the support surface, the detachable tray anchored to opposing side sections of the support belt and an inner side surface of the support surface, the inner side surface defining the opening, the inner side surface located between the opposing side section.

5. The wearable support belt of claim 4, wherein the detachable tray includes an extension extending from a base of the detachable tray, the detachable tray including opposing side extensions extending from the base, the opposing side extensions orthogonal to a plane of the extension.

6. The wearable support belt of claim 4, further comprising:

a third material disposed between the first material and the second material.

7. The wearable support belt of claim 6, wherein the third material is a rigid material.

8. The wearable support belt of claim 6, wherein a thickness of the third material is one of less than, more than or equivalent to a thickness of any of the first material or the second material.

9. The wearable support belt of claim 4, wherein the section coupling the first end and the second end includes multiple layers of the second material.

10. The wearable support belt of claim 9, wherein the first material is disposed between the multiple layers of the second material.

11. A wearable support belt, comprising:

a support belt having a first end and a second end, the first end and the second end moving between a closed and an open position, the first end and the second end defining an opening adapted to fit around a user's waist when in the closed position, the support belt having side support surfaces for resting a portion of a forearm of a user when in the closed position, the support belt composed of a first material and a second material, the first material disposed over the second material, the first material being softer than the second material, an inner side surface of a front support surface curved between the first end and the second end;

a section coupling the first end and the second end, the section coupling the first end and the second end having a thickness and a height that is one of different or equivalent to a thickness and a height of a front section of the structure, the section coupling the first end and the second end having the first material and the second material;

a removable cover disposed around the support belt, the removable cover having an outer surface, the outer surface having a fastening mechanism affixed thereto, the fastening mechanism affixed to both the first end and the second end; and a detachable portion attached to an outer side surface of the front surface, the detachable portion extending from the outer side surface of the front surface, wherein a support surface of the detachable portion is one of inclined downward toward the opening or level with a surface of the detachable portion, and wherein the detachable portion includes a tray that includes an extension extending from a base of the tray, the tray including opposing side extensions extending from the base, the opposing side extensions orthogonal to a plane of the extension.

12. The wearable support belt of claim 11, wherein the section coupling the first end and the second end includes multiple layers of the second material.

13. The wearable support belt of claim 11, wherein the first material is disposed between the multiple layers of the second material.

* * * * *